United States Patent [19]

Norwalt et al.

[11] 4,163,555

[45] Aug. 7, 1979

[54] SLOT CAR GAME WITH SPIN-OUT RECOVERY CAPABILITY

[75] Inventors: Robert H. Norwalt; Edward R. Hibbert, both of Northridge; Vicki L. Schiff, Redondo Beach, all of Calif.

[73] Assignee: Sega Corporation, Redondo Beach, Calif.

[21] Appl. No.: 871,261

[22] Filed: Jan. 23, 1978

[51] Int. Cl.[2] ..... A63F 9/14

[52] U.S. Cl. ..... 273/86 B; 46/257; 104/60; 104/172 B

[58] Field of Search ..... 273/86 B, 86 R; 46/201, 46/202, 257, 258, 259, 260, 261, 206; 104/60, 149, 150, 151, 172 B

[56] References Cited

U.S. PATENT DOCUMENTS

| | | | |
|---|---|---|---|
| 1,814,262 | 7/1931 | Redford | 104/172 B |
| 2,631,853 | 3/1953 | Haynes et al. | 273/86 B |
| 2,687,304 | 8/1954 | Northrop et al. | 273/86 B |
| 2,786,680 | 3/1957 | Northrop et al. | 273/86 B |
| 3,552,322 | 1/1971 | Clowes | 104/172 B |
| 3,930,333 | 1/1976 | De Anda | 46/202 |

FOREIGN PATENT DOCUMENTS

| | | | |
|---|---|---|---|
| 776240 | 10/1934 | France | 273/86 B |

*Primary Examiner*—Anton O. Oechsle
*Attorney, Agent, or Firm*—Gregory J. Battersby

[57] ABSTRACT

An improved slot car game is provided having a roadway with at least one slotted track and at least one electrical contact strip positioned adjacent to said track. At least one slot car vehicle is adapted to travel about the track deriving electrical power from said at least one electrical contact strip. Means are provided to realign a misaligned vehicle, said means including a guide secured to the underside of each of the vehicles and a continuous chain positioned below each of the slotted tracks with engaging means at fixed positions thereon. The chain may be moved in a horizontal direction to permit the engaging means of the chain to engage the guide means of the vehicle and, upon further horizontal movement of the chain, to realign the vehicle relative to the track.

10 Claims, 7 Drawing Figures

SLOT CAR GAME WITH SPIN-OUT RECOVERY CAPABILITY

BACKGROUND OF THE INVENTION

The present invention relates generally to a slot car game for use as a toy or in an amusement park and, more particularly, to a slot car game which includes means to realign the slot car after a spin-out or other misalignment.

Slot car games have traditionally been very popular in amusement parks and, in recent years, in the home. Such games include a roadway having a network of continuous slotted tracks around which one or more slot car vehicles travel. The roadways are generally laid out in such a manner that at least two tracks are directly adjacent one another to permit direct competition between at least two cars. Continuous contact strips are provided around the track adjacent the tracks for providing electrical power to the cars.

The slot cars used in such a game are normally scale models of full size automobiles which include four conventional wheels and an electric motor. The motor derives electrical power from the contact strips provided about the track and, by use of a transmission, converts the power into mechanical energy to drive the wheels and thus power the car. Most slot cars include a guide bar which extends downwardly from underside of the car into the slotted track to secure the car to the roadway and to provide direction for it. Most cars do not have steerable front wheels and thus rely on this guide bar to direct it.

An inherent problem with slot car racing games is that in order to simulate road racing conditions and to add to the excitement of the game, the roadways are normally laid out with numerous sharp curves which require a high degree of skill to negotiate at full speed. Since the slot cars are generally over-powered, it is quite common for a car entering a curve at too high a speed to lose its control and "spin out". This could result in the car actually disengaging itself from the slotted track or merely having its rear end swinging out such that the car will lose contact with the contact strips and thus lose power. The operator would then have to manually realign the car for continued competition.

Attempts have heretofore been made to prevent spin-outs and/or to realign the car after such a swing out. One attempt to prevent spin-outs was to reduce the available power for the car to more closely match its weight. This, however, proved difficult because, in some instances, it resulted in the car swinging broadside upon the application of additional power when entering a curve. Another approach to prevent spin-outs was to provide a differential front wheel drive slot car vehicle as described in U.S. Pat. No. 3,304,652 which issued to W. T. Donofrio on Feb. 21, 1967. Still another approach was to provide a steering guide for the cars as described in U.S. Pat. No. 3,314,375 which issued to J. B. Russell et al on Apr. 18, 1967. Relatively few attempts have been made to automatically realign the vehicle after such a spin-out or other loss or power.

Against the foregoing background, it is a primary objective of the present invention to provide a slot car game having slot car vehicles which are resistant to leaving the slot.

It is another objective of the present invention to provide a slot car game which incorporates means for re-orienting or realigning the car on the track by its operator after a spin-out or other misalignment causing a loss or power.

SUMMARY OF THE INVENTION

To the accomplishment of the foregoing objects and advantages, the present invention, in brief summary, comprises an improved slot car game having a roadway with at least one slotted track and at least one electrical contact strip positioned adjacent to said track. At least one slot car vehicle is adapted to travel about the track deriving power from said at least one electrical contact strip. Means are provided to realign a misaligned vehicle, said means including a guide secured to the underside of each of the vehicles and a continuous chain positioned below each of the slotted tracks with engaging means positioned at fixed positions thereon. The chain may be moved by control means in a horizontal direction to permit the engaging means on said chain to engage the guide means of the vehicle and, upon further horizontal movement of the chain, to realign the vehicle relative to the track.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
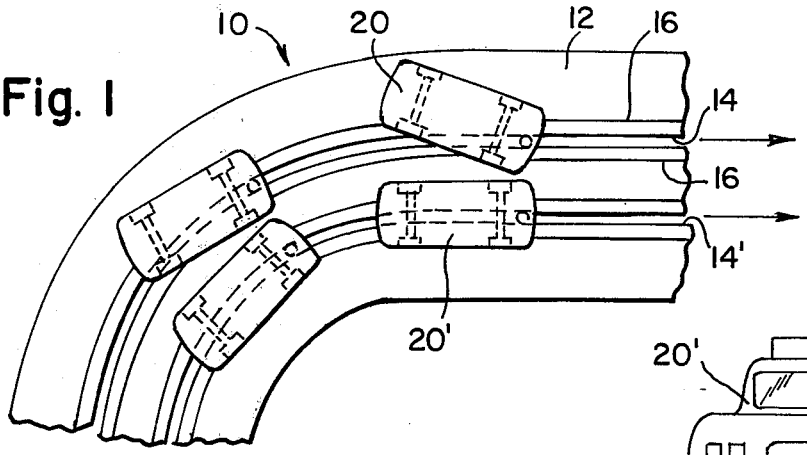
FIG. 1 is a top plan view of a portion of a slot car track including slot cars.

Referring now to the drawings and, in particular, to FIG. 1 thereof, there is shown a portion of a slot car game referred to generally by reference numeral 10, which includes a conventional roadway 12 having a pair of slotted tracks 14 and 14' about which slot car vehicles 20 and 20' are adapted to travel, generally in head to head competition. Electrical contact strips 16 are provided on either side of the tracks 14 and 14' for supplying power for the slot cars 20 and 20'. Each pair of electrical contact strips 16 are electrically connected to an external power source (not shown), preferably a variable power D.C. transformer, by which the operator of the slot car may adjust the amount of electrical power to the strip 16 and therefore may control the speed of the car about the track since the speed of a slot car is directly related to the amount of electrical current introduced into the car through the contact strip 16. Preferably, the external power supply should supply between about 12 and about 18 volts of D.C. current to the contact strips 16 and thus to the slot car.

Figure 3:
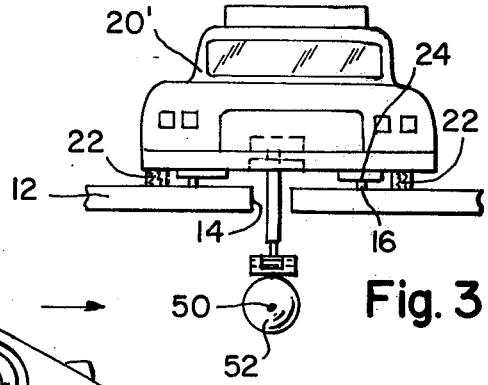
FIG. 3 is a rear view of car 20' of FIG. 1.
Figure 2A:
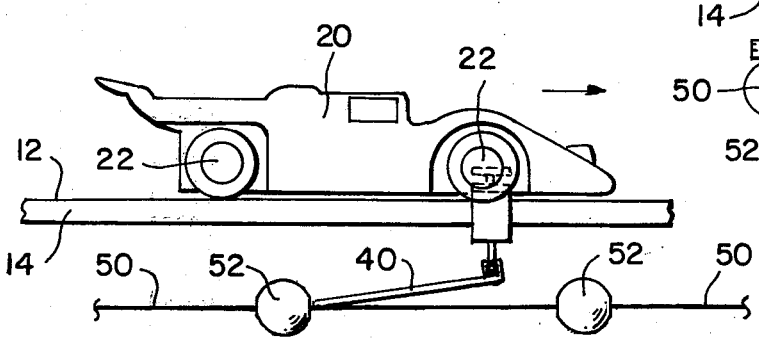
FIG. 2A is a side view of car 20 of FIG. 1 when the car has spun out and lost power.
Figure 2:
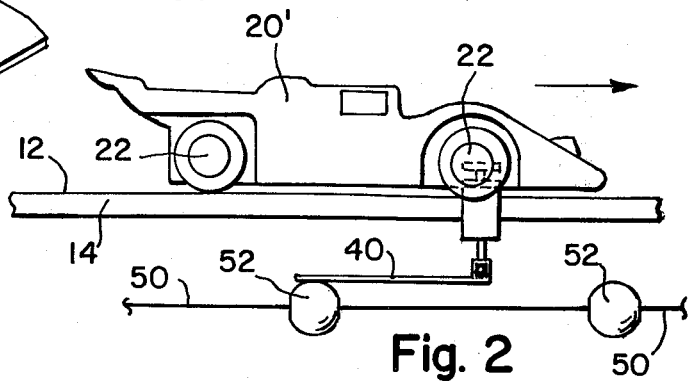
FIG. 2 is a side view of car 20' of FIG. 1 illustrating its placement in slot 14' as is traveling around the track under power.

The slot cars 20, as shown in FIGS. 2 and 3, are also of conventional design and are fabricated from a thermoplastic or metallic material. As scale down replicas of conventional automobiles, they include four wheels 22 which are powered by an electric motor (not shown) contained within the car 20. The electric motor, of conventional design, receives D.C. current from a pair of electrical contact points 24 on the undersurface of the cars 20 which, during operation, ride along electrical contact strips 16 on the roadway 12. The electric motor supplies power to a transmission (not shown) within the car which converts the electrical power derived from the contact strip 16 to mechanical power to drive the wheels.

Figure 4:
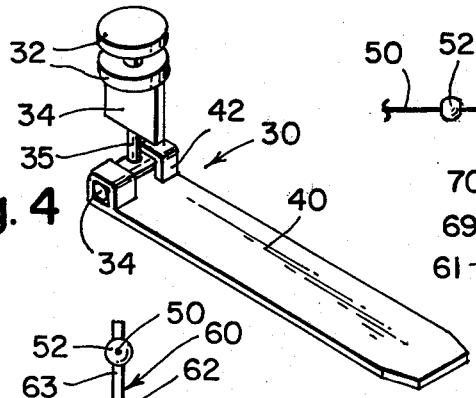
FIG. 4 is a perspective view of the slot guide of the present invention.

The slot cars 20 are guided about and releasably secured to the roadway by means of a projection or guide 30 which projects downwardly from the forward portion of the underside of the cars 20 into the slots 14 and which serves to retain the cars 20 within the slots 14 as they pass around the track. As shown in greater detail in FIG. 4, the guide 30 includes a double disc upper portion 32 which is adapted to pivotably engage a receptacle (not shown) within the cars 20 in such a manner to permit movement and rotation of the cars as they travel around the track, particularly around the curved portions thereof. Extending downwardly from the upper portion 32 is a vane portion 34 which, during operation, rides along and within the slotted track. Vane portion 34 is connected to a base portion 36 by means of a tubularly shaped extension 35. The length of the base portion 36 is greater than the width of the slotted track 14 in order to positively retain the guide 30 within the slotted track 14 and thus slidably secure the car 20 to the roadway 12. The base portion 36 of the guide 30 is pivotably secured to a flag portion 40 by retention within a partially enclosed tail portion 42 at one end of the flag portion 40.

Figure 5:
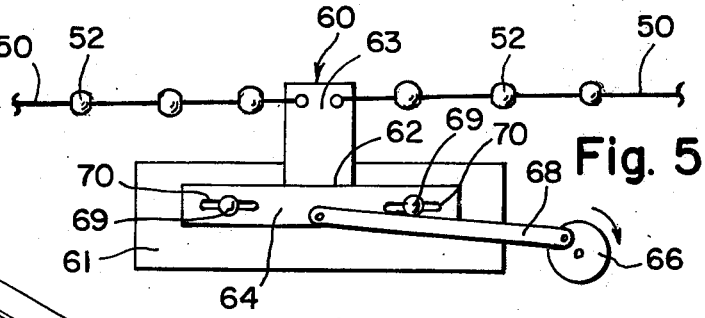
FIG. 5 is a side view of the chain activator of the present invention.
Figure 6:
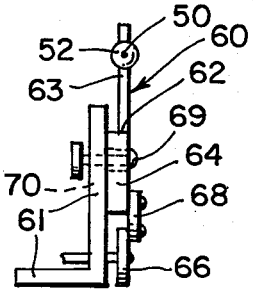
FIG. 6 is a front view of the chain activator of FIG. 5.

As shown in FIGS. 2 and 3, a continuous chain 50 is provided below the surface of the roadway under each of the slotted tracks 14 with bead or ball shaped engaging portions 52 positioned at fixed intervals about the chain 50. This chain 50, in normal operation, is stationary. As shown in FIGS. 5 and 6, means are provided to move the chain in an oscillatory, horizontal manner by use of a chain activator 60. Chain activator 60 includes a stationary base portion 61 which may be secured to the base of the table or floor underneath the roadway and a slideable element 62 with upper and lower portions 63 and 64. Upper portion 63 is secured to the chain 50 and lower portion 64 is secured to a motor driven crank 66 by a linkage 68. Slideable element 62 is slideably secured to the base portion 61 by means of retaining bolts 69 which are retained within slots 70 to allow it to slide back and forth in a horizontal direction upon activation of the motor crank 66. The linkage 68 converts the rotary motion of the crank 66 into horizontal motion of the slideable element 62 thus moving the chain 50 in a horizontal direction. The motor driven crank 66 is connected to an electric motor (not shown) which is controlled by control means (not shown) to permit activation by the operator of the car.

In actual operation of the slot car game, as the cars 20 travel around the track, the chain 50 underneath the slotted roadway remains stationary. As shown in FIG. 2, the flag portion 40 of guide 30 which is in a horizontal position relative to the verticle guide 30 is dragged over the stationary chain 50 and the bead shaped engaging portions 52 with minimal frictional resistance. When, however, a spin-out or other misalignment occurs, as illustrated in FIG. 1, and a car 20 loses electrical contact with the contact strip 16, the operator of the car can activate the chain 20 to creat horizontal, oscillatory movement thereof, using the control means to activate the motor driven crank 66. Since the car is then stationary, gravity will cause the flag portion 40 to drop from its horizontal position toward the chain 50 and to engage one of the bead shaped engaging means 52 as shown in FIG. 2A. As the chain 50 is moved first in a forward direction, the flag portion 40 engages the bead shaped engaging means 52 of the chain pulling the car 20 in a forward direction. Since the rear portion of the car 20 will track the front portion when pulled from the front portion, the position of the car 20 will be returned to normal with its contact points 24 again contacting strips 16 and thus restore power to the car. At such time, the operator, by the control means, would shut off power to the crank 66 and restore the chain 60 to its stationary position until the next spin-out. The oscillatory or back and forth horizontal motion of the chain 50, upon activation, by the control means, permits engagement of the flag portion 40 in whatever position the car comes to rest relative to the bead shaped engaging means 52 of the chain 50.

Having thus described the invention with particular reference to the preferred forms thereof, it will be obvious that various changes and modifications may be made therein without departing from the spirit and scope of the invention as defined in the. appended claims.

What is claimed is:

1. Improved slot car apparatus including a roadway having at least one slotted track with and at least one electrical contact strip positioned relative to each track and connected to an electrical power source, and at least one slot car vehicle adapted to travel about each of said oscillatory tracks deriving its electrical power from said at least one electrical contact strip, wherein the improvement comprises means to realign said at least one slot car vehicle after misalignment, said means comprising:

guide means secured to the underside of said at least one vehicle projecting vertically into said slotted track; and a continuous chain positioned below each of said at least one slotted track having engaging means at fixed locations about said track, said continuous chain adapted to be activated to permit the engaging means on said chain to engage the guide means of said misaligned vehicle and realign said vehicle.

2. The apparatus of claim 1 wherein said guide means are pivotably secured to said vehicle and include a generally horizontally extending flag portion at one end thereof.

3. The apparatus of claim 2 wherein said flag portion is pivotably secured to said guide means.

4. The apparatus of claim 3 wherein said engaging means are bead shaped.

5. The apparatus of claim 4 wherein said control means are adapted to activate a motor driven rotary crank which moves said chain in an oscillatory, horizontal direction.

6. The apparatus of claim 5 wherein a chain activator is provided connecting said crank to said chain for converting the rotary motion of said crank to horizontally move said chain.

7. The apparatus of claim 6 wherein said chain activator comprises a base portion and a slideable element slideably mounted on said base portion, said slideable element being secured at one end to said chain and at another end to a linkage which is secured to said crank, said linkage being adapted to convert the rotary motion of said crank to a horizontal motion for said slideable element.

8. The apparatus of claim 7 wherein the flag portion of a misaligned vehicle is adapted to engage the ball shaped engaging means on said chain upon misalignment.

9. The apparatus of claim 8 wherein the oscillatory horizontal motion of said chain after engagement of the engaging means of said chain with the flag portion of said vehicle effects realignment of the vehicle.

10. The apparatus of claim 9 wherein said chain is adapted to be returned to a stationary position after realignment of a vehicle.

* * * * *